US009713738B2

(12) United States Patent
Schrag

(10) Patent No.: US 9,713,738 B2
(45) Date of Patent: Jul. 25, 2017

(54) APPARATUS FOR EXERCISING THE MUSCLES

(71) Applicant: BLBW AG, Schwarzsee (CH)

(72) Inventor: Michael Schrag, Schwarzsee (CH)

(73) Assignee: BLBW AG, Schwarzsee (CH)

( * ) Notice: Subject to any disclaimer, the term of this patent is extended or adjusted under 35 U.S.C. 154(b) by 0 days.

(21) Appl. No.: 14/770,122

(22) PCT Filed: Mar. 20, 2013

(86) PCT No.: PCT/EP2013/055822
§ 371 (c)(1),
(2) Date: Aug. 25, 2015

(87) PCT Pub. No.: WO2014/146710
PCT Pub. Date: Sep. 25, 2014

(65) Prior Publication Data

US 2016/0016033 A1 Jan. 21, 2016

(51) Int. Cl.
*A63B 21/008* (2006.01)
*A63B 22/00* (2006.01)
(Continued)

(52) U.S. Cl.
CPC .... *A63B 22/0046* (2013.01); *A63B 21/00069* (2013.01); *A63B 21/00072* (2013.01);
(Continued)

(58) Field of Classification Search
CPC ..... A63B 22/0046; A63B 22/0002; A63B 22/0015; A63B 22/0048; A63B 21/00069;
(Continued)

(56) References Cited

U.S. PATENT DOCUMENTS 2,261,172 A 11/1941 Maxwell
4,275,882 A * 6/1981 Grosser ..... A63B 21/00072 482/112
(Continued)

FOREIGN PATENT DOCUMENTS

DE 4433168 A1 3/1996
EP 2269698 A1 1/2011
(Continued)

OTHER PUBLICATIONS

International Search Report and Written Opinion dated Jan. 7, 2014 for PCT/EP2013/055822.

*Primary Examiner* — Loan H Thanh
*Assistant Examiner* — Megan Anderson
(74) *Attorney, Agent, or Firm* — Pearne & Gordon LLP

(57) ABSTRACT

An apparatus for exercising the muscles, comprising a power arm having actuating elements at one end area, and where the other end of the power arm is pivotally connected to a holding element through a first hinge. The apparatus further comprises a spring element, wherein one end of the spring element is linked to the power arm at a first articulation point, and a second end of the spring element is linked to the holding element through a second articulation point. A support is further included which lies on an imaginary plane defined by an x-axis and a y-axis. The holding element is connected to the support by a rotary hinge which allows the holding element to rotate with respect to the support about a shaft which lies on an axis that is normal to the imaginary plane.

14 Claims, 13 Drawing Sheets

(51) Int. Cl.

| | |
|---|---|
| ***A63B 21/16*** | (2006.01) |
| ***A63B 23/035*** | (2006.01) |
| ***A63B 21/00*** | (2006.01) |
| ***A63B 23/12*** | (2006.01) |
| *A63B 71/00* | (2006.01) |

(52) U.S. Cl.

CPC ..... *A63B 21/0087* (2013.01); *A63B 21/16* (2013.01); *A63B 21/169* (2015.10); *A63B 21/4019* (2015.10); *A63B 21/4035* (2015.10); *A63B 21/4047* (2015.10); *A63B 22/0002* (2013.01); *A63B 22/0015* (2013.01); *A63B 22/0048* (2013.01); *A63B 23/0355* (2013.01); *A63B 23/03508* (2013.01); *A63B 23/03525* (2013.01); *A63B 23/12* (2013.01); *A63B 21/1681* (2013.01); *A63B 21/4034* (2015.10); *A63B 2071/0081* (2013.01); *A63B 2208/0204* (2013.01); *A63B 2210/06* (2013.01); *A63B 2210/50* (2013.01); *A63B 2225/093* (2013.01)

(58) Field of Classification Search

CPC ..... A63B 21/4035; A63B 21/4019; A63B 21/169; A63B 21/4047; A63B 21/16; A63B 21/0087; A63B 21/00072; A63B 21/4034; A63B 21/1681; A63B 23/12; A63B 23/03508; A63B 23/0355; A63B 23/03525; A63B 2208/0204; A63B 2225/093; A63B 2071/0081; A63B 2210/50; A63B 2210/06

See application file for complete search history.

(56) References Cited

U.S. PATENT DOCUMENTS

| | | | | | |
|---|---|---|---|---|---|
| 4,397,462 | A * | 8/1983 | Wilmarth | A63B 21/0087 | 482/113 |
| 4,618,140 | A * | 10/1986 | Brown | A63B 22/0076 | 482/112 |
| 5,605,524 | A * | 2/1997 | Husted | A63B 21/00072 | 482/112 |
| D394,482 | S * | 5/1998 | Colonello | D21/673 | |
| 6,328,679 | B1 | 12/2001 | Croft | | |
| 7,678,032 | B2 * | 3/2010 | Footnick | A63B 21/0083 | 482/111 |
| 8,992,393 | B2 * | 3/2015 | Reyes | A63B 21/08 | 482/100 |
| 2006/0040799 | A1 | 2/2006 | Pompile | | |
| 2012/0190513 | A1 * | 7/2012 | Bonds | A63B 21/008 | 482/114 |
| 2014/0051556 | A1 * | 2/2014 | Abassian | A63B 21/0414 | 482/129 |

FOREIGN PATENT DOCUMENTS

| | | | |
|---|---|---|---|
| FR | 2759917 | A1 | 8/1998 |
| GB | 2268086 | A | 1/1994 |
| WO | 9714475 | A1 | 4/1997 |
| WO | 2006051247 | A1 | 3/2006 |

* cited by examiner

APPARATUS FOR EXERCISING THE MUSCLES

This invention relates to an apparatus for exercising the muscles, comprising a power arm, which at one end area is equippable with actuating elements and which, with the other end area, is pivotable about a first hinge which is disposed on a holding element, to which power arm the one end area of a spring element is linked in an articulated way at a first articulation point, the other end area of which spring element is linked in an articulated way at a second articulation point on the holding element.

Such apparatuses for exercising the muscles are known in diverse designs. The document U.S. Pat. No. 6,328,679 B1 shows, for example, such an apparatus in which a power arm, which has the shape of a bracket, can be pivoted in one direction against the action of a resilient force. With this apparatus groups of muscles of a human body can be exercised, in particular in the region of arms and shoulder. When other groups of muscles are supposed to be exercised it is necessary to use other machines or equipment. Thus when as many groups of muscles as possible of a human body are supposed to be exercised, it is necessary to have a multiplicity of corresponding apparatuses available, each of these apparatuses being suitable in an optimal way to exercise a group of muscles. For a comprehensive exercising of the muscles of a human body it is thus necessary either to purchase different suitable apparatuses, having as a consequence high outlay costs in addition to the large space requirements, or one goes to a fitness or therapy center at which the various devices for exercising different groups of muscles are made available. Going to such a fitness or therapy center however entails the corresponding expenditure of time.

The object of the present invention thus consists in providing an apparatus for exercising the muscles which is able to be set and adjusted in such a way that the most diverse groups of muscles are able to be exercised in the most diverse ways, this apparatus has a simple structure, the space requirement and own weight are minimal, and the purchase costs can be kept low.

This object is achieved according to the invention in that this apparatus has a holding element, which is connected via a rotary hinge to a support and is rotatable about this support in one plane and is lockable in each correspondingly set rotation position.

This solution according to the invention makes it possible for the power arm to be set in each angular position whereby a pressing, pushing and pulling in vertical direction can be carried out. The pressing, pushing, pulling, etc. can also be exerted in horizontal direction. Moreover pressing, pushing, pulling etc. can take place in every inclined position. Thus through suitable arrangement of this apparatus practically every group of muscles of a human body can be exercised and treated. It is not necessary for a multiplicity of devices having different functions to be used.

The holding element is preferably designed as arm at whose one end area the first hinge is disposed and at whose other end area the other end area of the spring element is linked in an articulated way, whereby an optimal introduction of the force results.

The power arm is preferably provided with an extension piece, on which the actuating elements are able to be provided, and which is able to be pushed into and pulled out of the power arm in a telescopic way and locked in the appropriate position. Achieved thereby is that the resistance can be changed and adapted to the needs.

Another advantageous embodiment of the invention consists in that the first articulation point is designed in an adjustable way so that the spacing of the first articulation point to the first hinge is able to be set. In this way the force effect on the power arm can be changed. Thereby changed will also be the characteristic of the force over the path of movement of the power arm. In combination with the increase in force in the spring element, declining, constant or increasing force paths can be achieved.

The support is preferably installed in a height-adjustable way on a stand, which stand is fixable with respect to a wall of a room or in the room, and is lockable at the set height. Exercises for training of muscle groups can be carried out standing, sitting or lying down or in other positions, which increases even further the possibilities of use of this apparatus.

Another advantageous embodiment of the invention consists in that the support is held at the respective height in the stand via a counterforce, which counterforce can be formed by a counterweight or a spring balancer. This counterforce corresponds approximately to the weight of the apparatus, whereby the apparatus can be brought to the desired height in the stand practically without any expenditure of effort and can be correspondingly locked.

The power arm and the spring element are preferably able to be separated from one another at the first articulation point so that the power arm is able to be swung closed toward the holding element, whereby the apparatus can be stored in a space-saving way when not in use.

A further advantageous embodiment of the invention consists in that the stand is disposed in a cupboard element, which is provided with doors, which can be closed in the state of the power arm being swung closed toward the holding element. The apparatus can thereby be stored optimally in this cupboard element when not in use. This cupboard element can be kept very slim. The apparatus provided with such a cupboard element can thereby be easily accommodated in any desired room of an apartment without taking up much space and, with correspondingly aesthetic design of the cupboard element, will not be perceived in any way as objectionable.

Another advantageous embodiment of the invention consists in that the spring element is designed as pneumatic cylinder, which results in a simple structure for the apparatus and many adjustment possibilities.

The pneumatic cylinder is preferably connected to a compressed air reservoir via a compressed air line, whereby it can be achieved that the force of the spring element acting upon the power arm undergoes a defined increase over the path of movement.

Preferably inserted in the compressed air line is a manometer and a pressure limit valve. Via the manometer the pressure can be monitored. The pressure limit valve prevents too high a pressure within the system, whereby damage can be avoided.

A further advantageous embodiment of the invention consists in that a pneumatic source is connectible to the compressed air line, and a depressurization system is used via which the pressure of the compressed air can be changed. Through this simple possibility for changing the pressure, the magnitude of the force to be expended can be optimally adjusted practically as desired.

Preferably, at one end area of the power arm or respectively on its extension piece the most diverse actuating elements can be used selectively. The possibilities for exercises and workout sessions which can be carried out with this apparatus are thereby supplemented in an optimal way.

An embodiment of the apparatus according to the invention for exercising the muscles will be explained more closely in the following, by way of example, with reference to the attached drawings.

FIG. 1*a* and FIG. 1*b* show the apparatus according to the invention in a lateral view and a spatial view with the power arm in the upper position and the articulation point of the spring element in the outermost position;

FIG. 2*a* and FIG. 2*b* show the apparatus according to the invention in a lateral view and a spatial view according to FIG. 1*a* and FIG. 1*b*, whereby the articulation point of the spring element is located in the innermost position;

FIG. 3*a* and FIG. 3*b* show the apparatus according to the invention in a lateral view and a spatial view, in which the power arm is moved slightly downward;

FIG. 4*a* and FIG. 4*b* show the apparatus according to the invention in a lateral view and a spatial view in which the power arm is located in the lowest position;

Figure 8A:
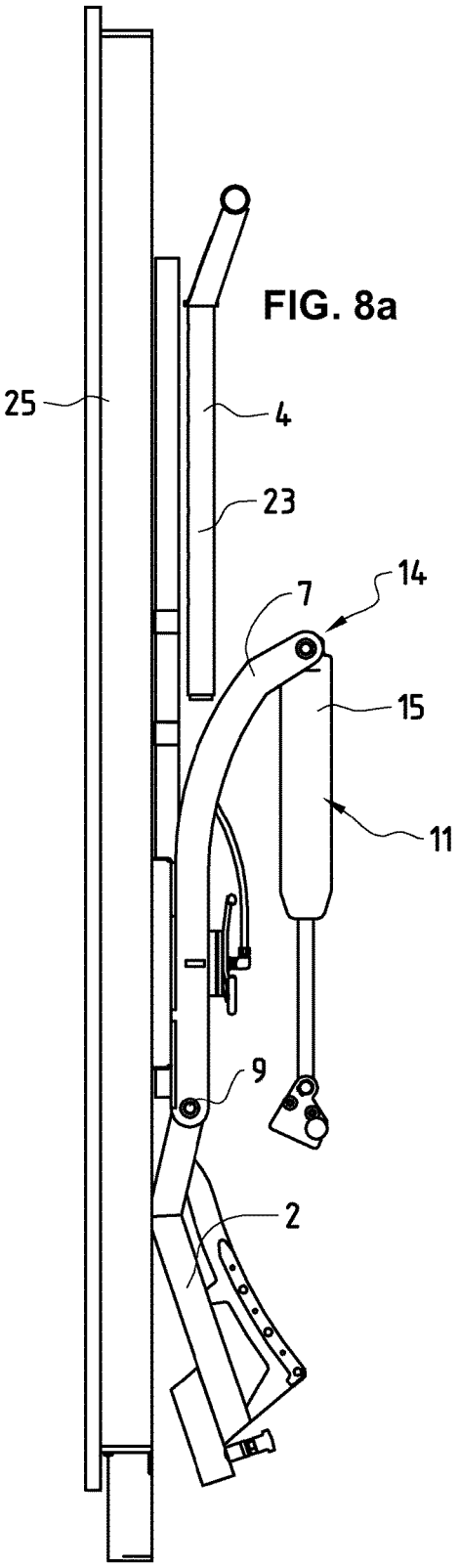
Figure 8B:
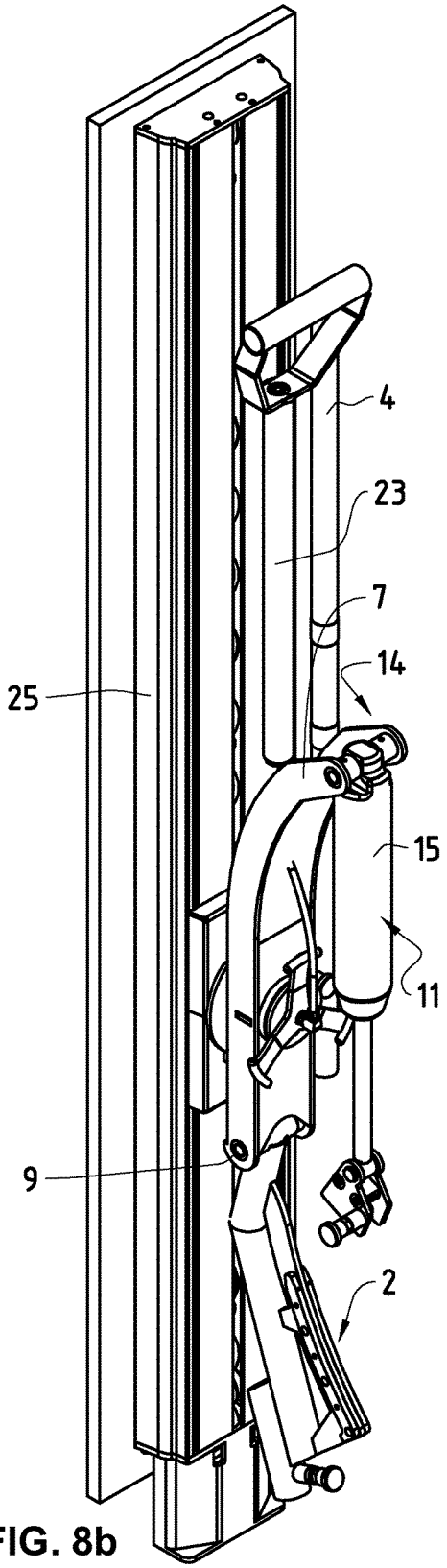
Figure 9A:
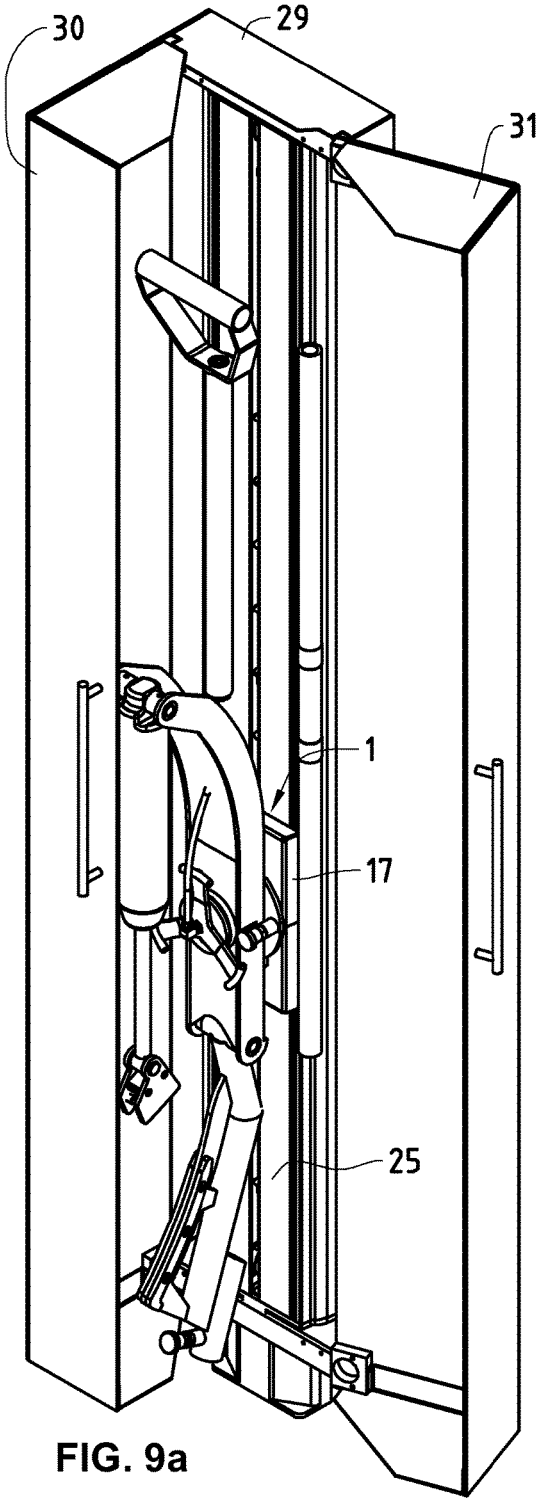
Figure 9B:
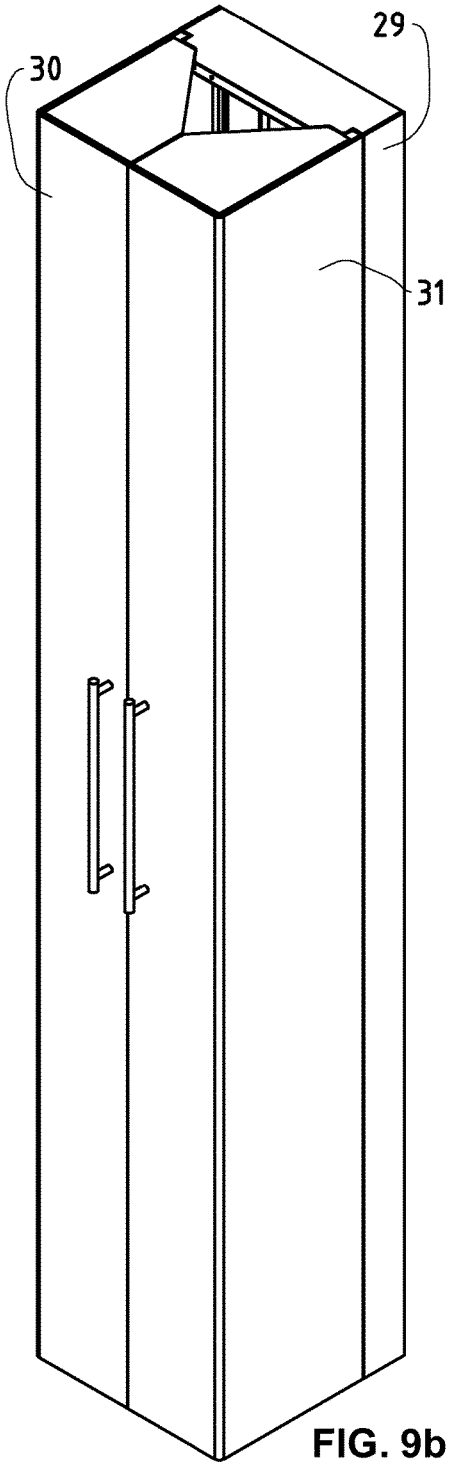
Figure 10:
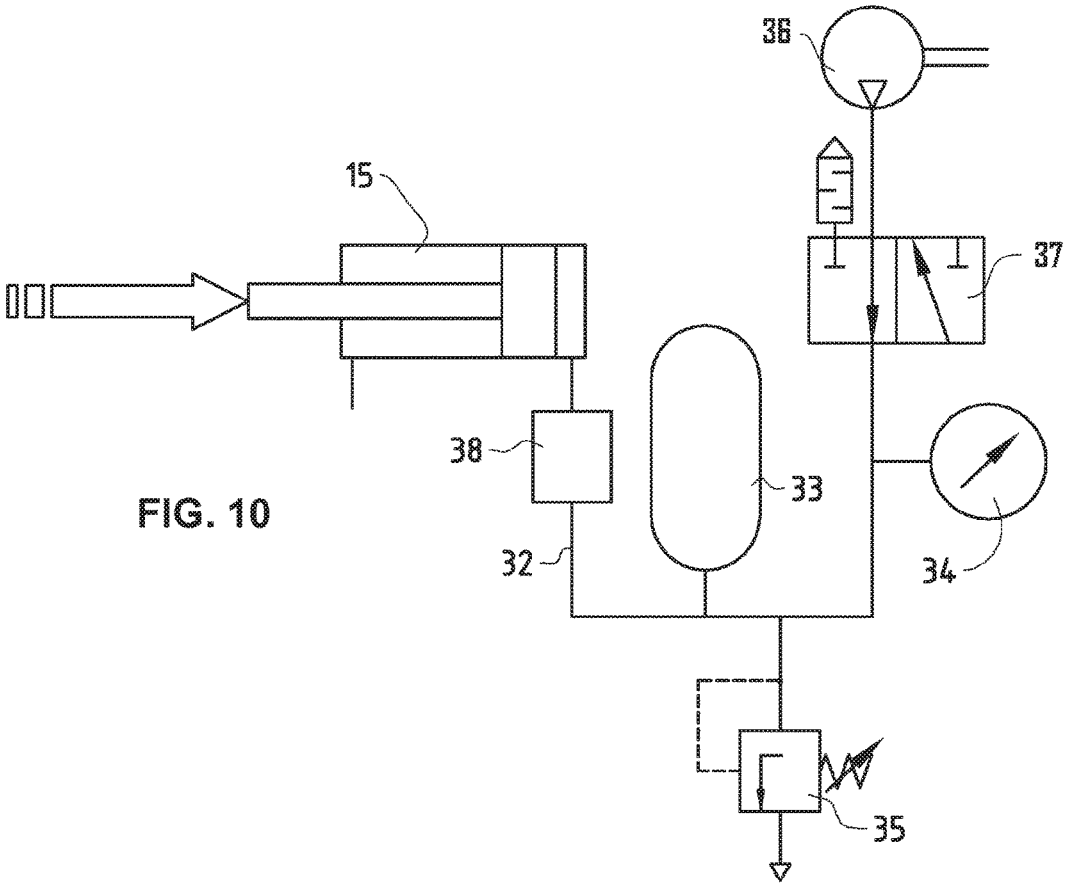
Figure 11:
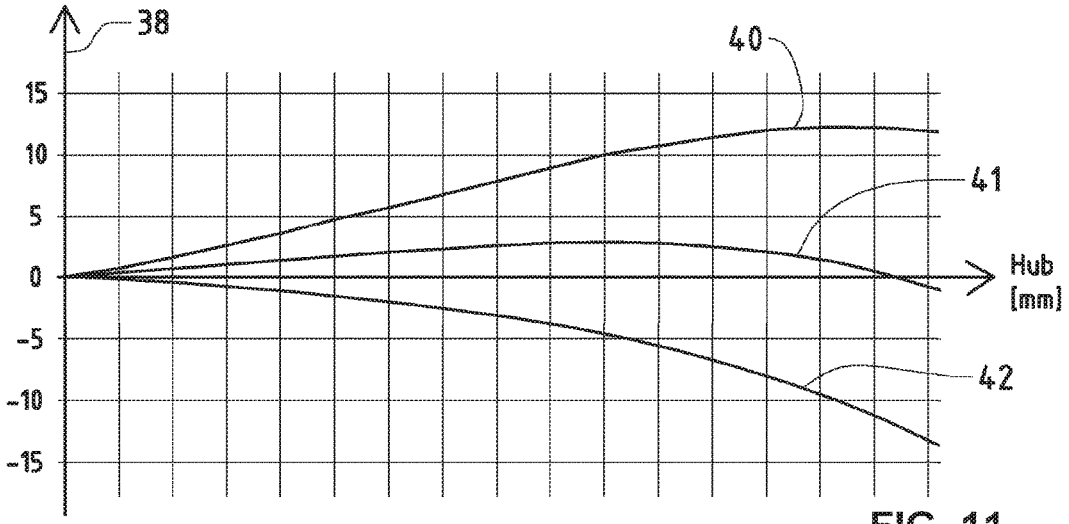
Figure 12A:
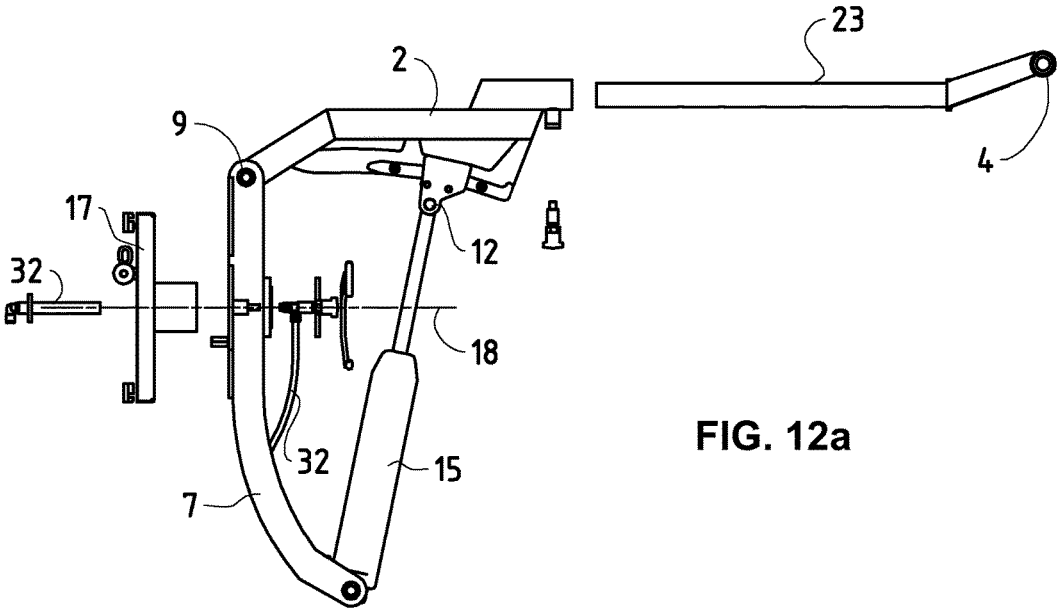
Figure 12B:
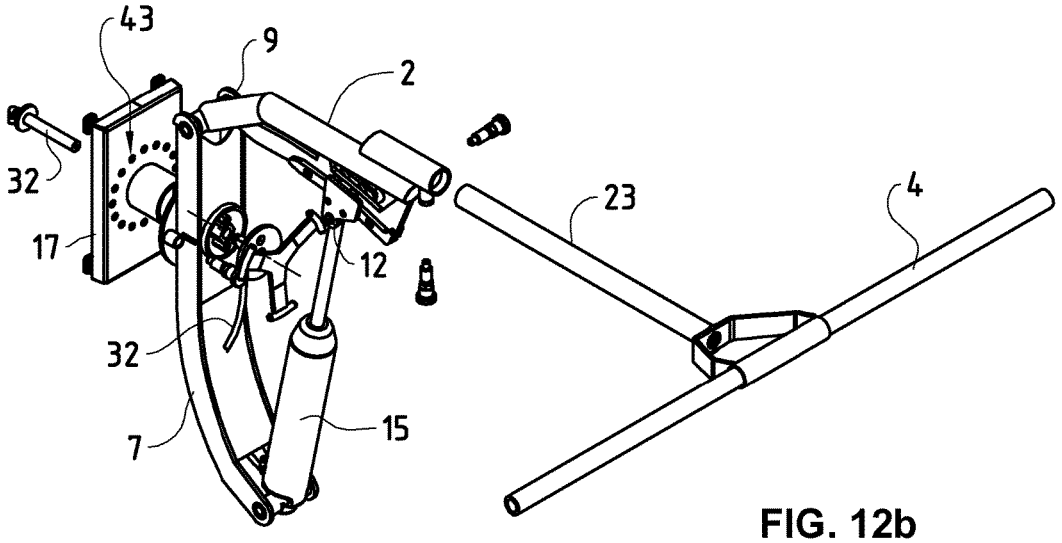
Figure 13:
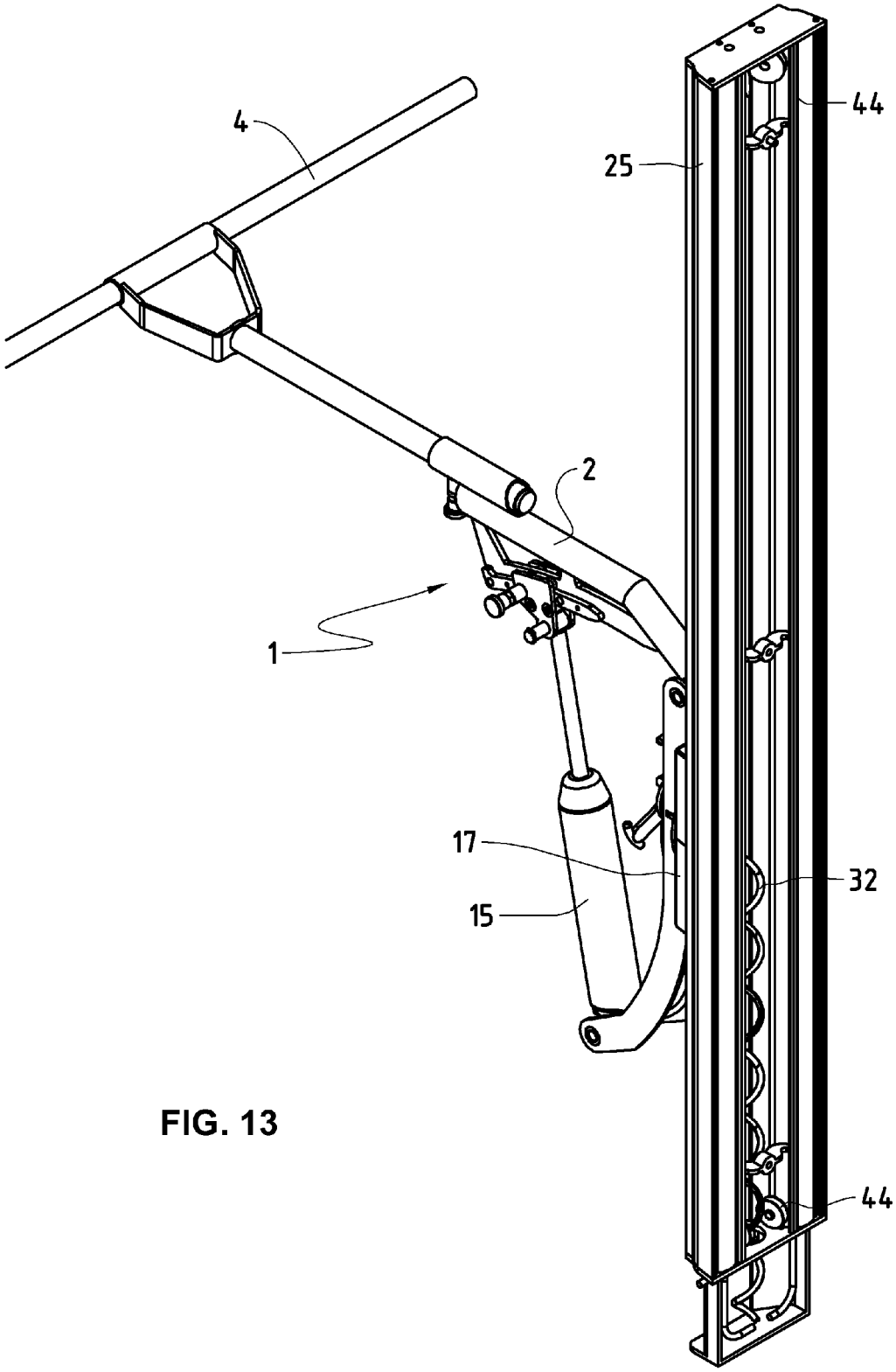

FIG. 8*a* and FIG. 8*b* show the apparatus according to the invention in a lateral view and a spatial view in which the power arm is separated from the spring element and the power arm is located in a pivoted-away position;

FIG. 9*a* and FIG. 9*b* show the apparatus according to the invention in a spatial view, which apparatus can be accommodated in a cupboard element that is provided with closable doors;

FIG. 10 shows a pneumatic connection diagram of the elements as they are used in the apparatus according to the invention;

FIG. 11 shows the representation of a multiplicity of possible force paths;

FIG. 12*a* and FIG. 12*b* each show an exploded view of the elements of the apparatus according to the invention; and FIG. 13 shows a view from behind of the stand of the apparatus according to the invention.

Figure 13A:
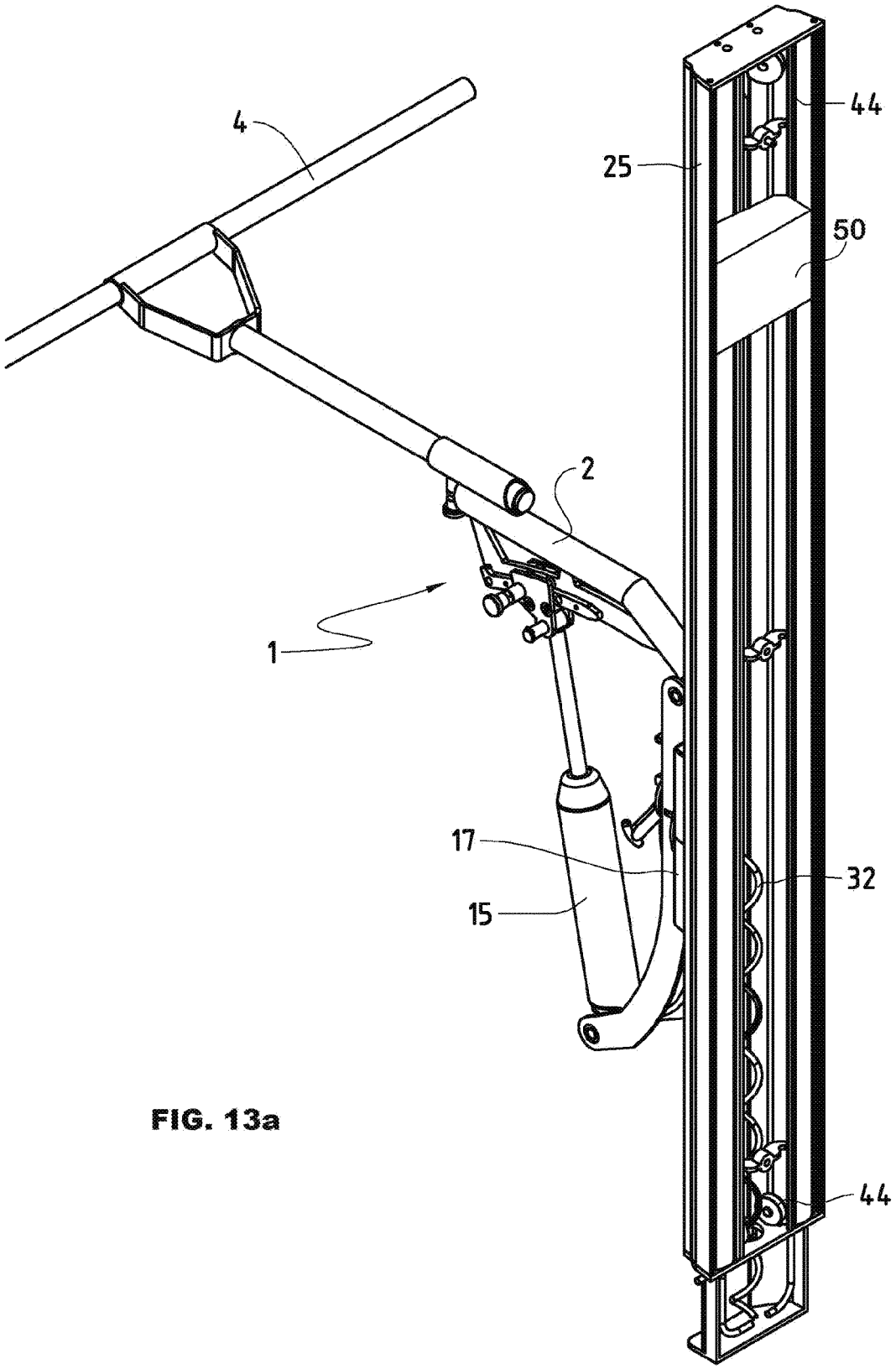

FIG. 13*a* shows a view similar to FIG. 13, but equipped with a counterbalance feature 50 as disclosed herein.

Figure 1A:
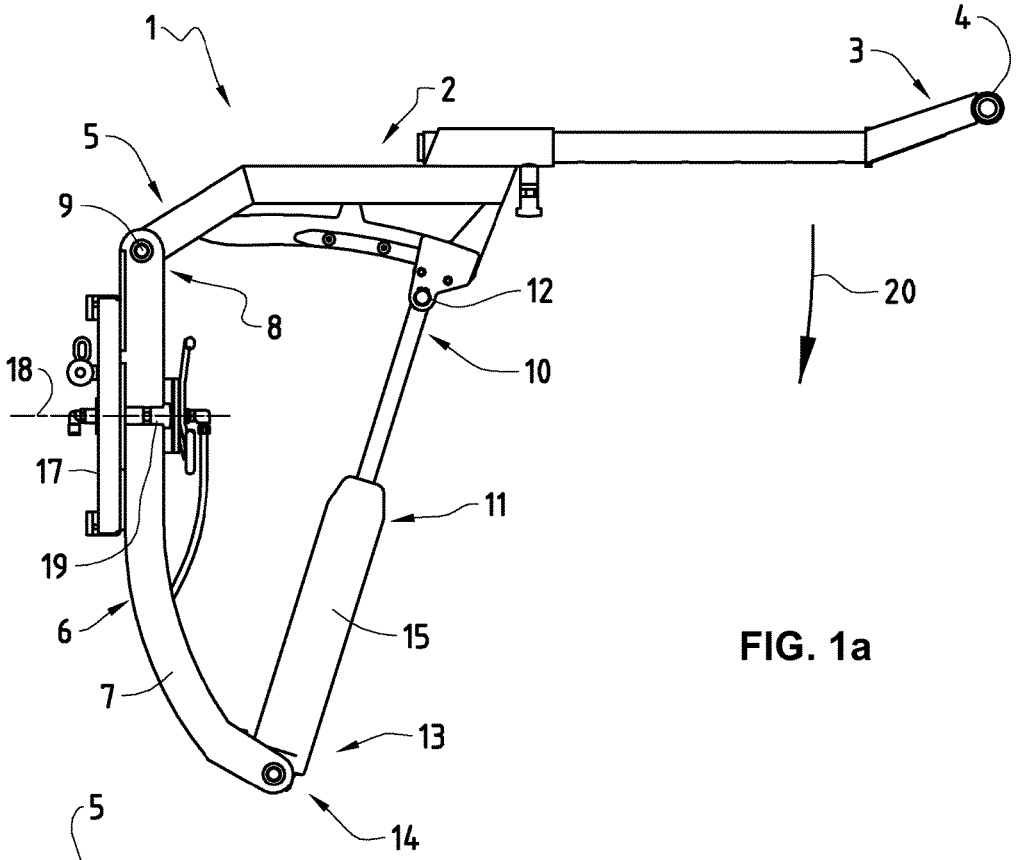
Figure 1B:
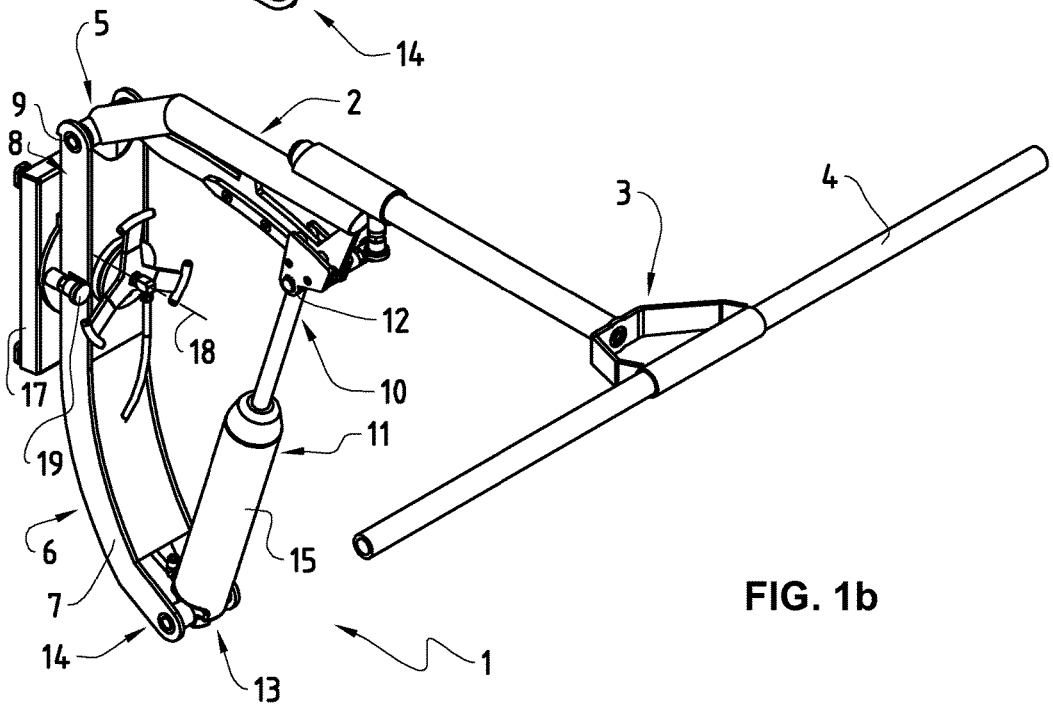

FIG. 1*a* and FIG. 1*b* show in a lateral view or respectively in a spatial view the apparatus according to the invention 1 for exercising the muscles. This apparatus 1 comprises a power arm 2. This power arm 2 can be equipped at one end area 3 with actuating elements 4, via which the power arm 2 can be actuated by the exercising person. At the other end area 5 the power arm 2 is provided with a first hinge 9. Via this first hinge 9 the power arm 2 is connected in an articulated way to a holding element 6 and is thereby pivotable with respect to this holding element 6.

The holding element 6 is designed as arm 7. Disposed on one end area 8 of this arm 7 is the first hinge 9. Linked in an articulated way to the power arm 2 at a first articulation point 12 is the one end area 10 of a spring element 11. The other end area 13 of the spring element 11 is linked in an articulated way at the other end area 14 of the arm 7. In this embodiment example the spring element 11 is designed as pneumatic cylinder 15, which will be described in detail later. Of course other suitable spring elements are also conceivable.

The holding element 6 or respectively the arm 7 are connected to a support 17 via a rotary hinge. The arm 7 is thereby rotatable with respect to the support 17 about the shaft 18. Placed on the arm 7 is a locking pin 19, which can be inserted in known bores (not shown) which are correspondingly disposed on the support 17 on a circular path. After pulling the locking pin 19 out of the corresponding bore of the support 17 the arm can be rotated with respect to the support 17 about the shaft 18. In this rotated position the locking pin can be inserted into the corresponding bore. The arm 7 is thus locked in this position with respect to the support 17. Of course other suitable locking systems can also be used.

The support 17 can be fixed to a corresponding stand, as will be seen later, or to a grid wall, for example, or another suitable element, so that the power arm 2 for exercising the muscles can be moved as is shown by the arrow 20.

Figure 2A:
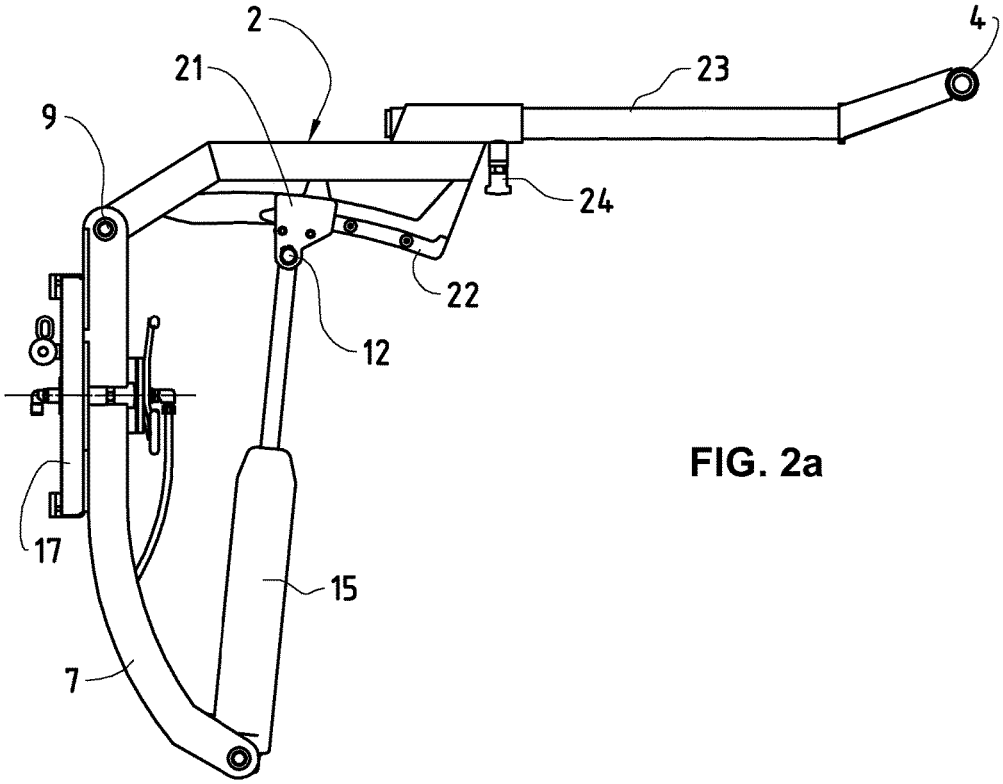
Figure 2B:
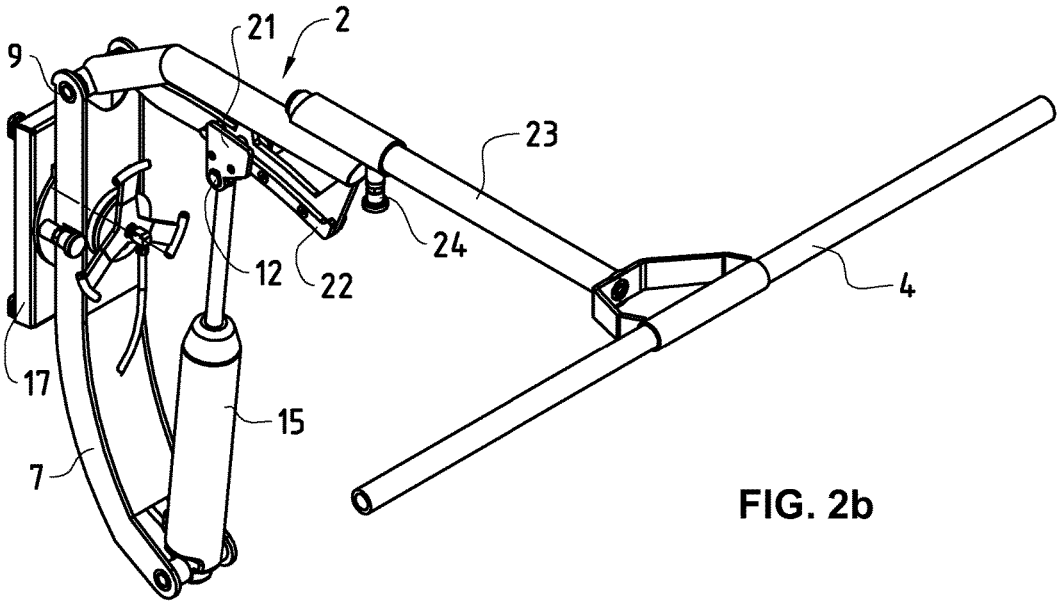

In FIG. 2*a* and FIG. 2*b* the same apparatus 1 is shown as in FIG. 1*a* and FIG. 1*b*. The power arm 2 is pivotably connected to the arm 7 via the first hinge 9. The arm 7 is held in a rotatable way on the support 17. The first articulation point 12 is disposed in an adjustable way on the power arm 2. The first articulation point 12 is located on a sliding piece 21, which can be moved along the track 22, which is attached on the power arm 2, in a known way, toward the first hinge 9 and away from this first hinge and can be fixed in the respective position in a known way (not shown). The leverage can thereby be changed which affects the force to be exerted with which the power arm 2 can be moved. Of course here too other known and suitable adjustment and fixing mechanisms are also conceivable.

The power arm 2 is provided with an extension piece 23, on which the actuating elements 4 are installed. The extension piece 23 is able to be pushed into the power arm 2 and pulled out of the power arm 2 in a telescopic way. The extension piece 23 can be locked in the corresponding position with respect to the power arm 2 in a known way via a further locking pin 24. Here too other known and suitable locking systems are also conceivable.

Figure 3A:
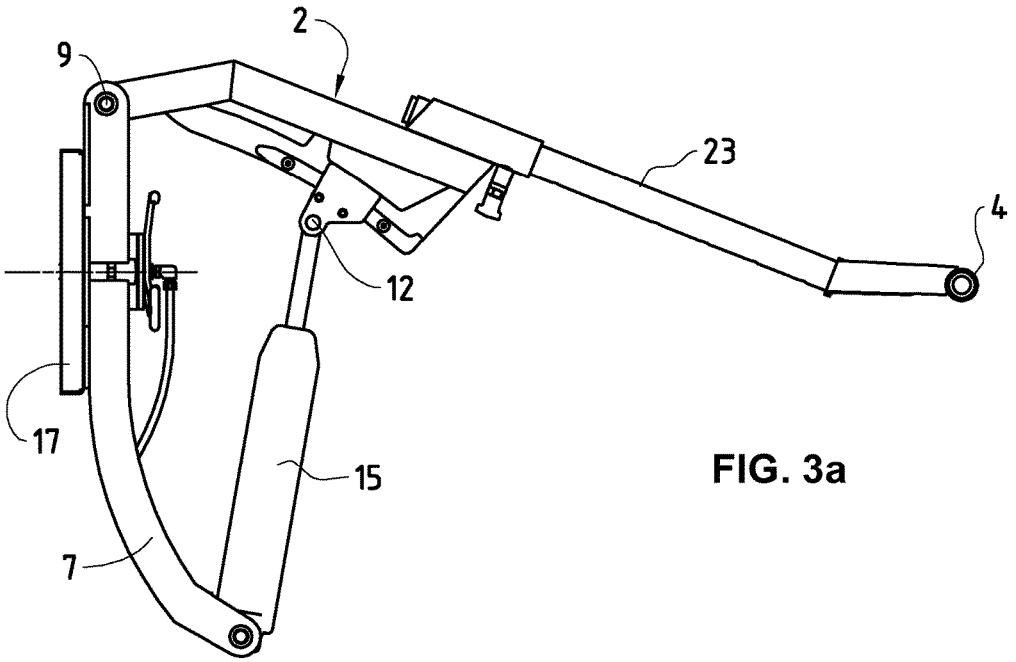
Figure 3B:
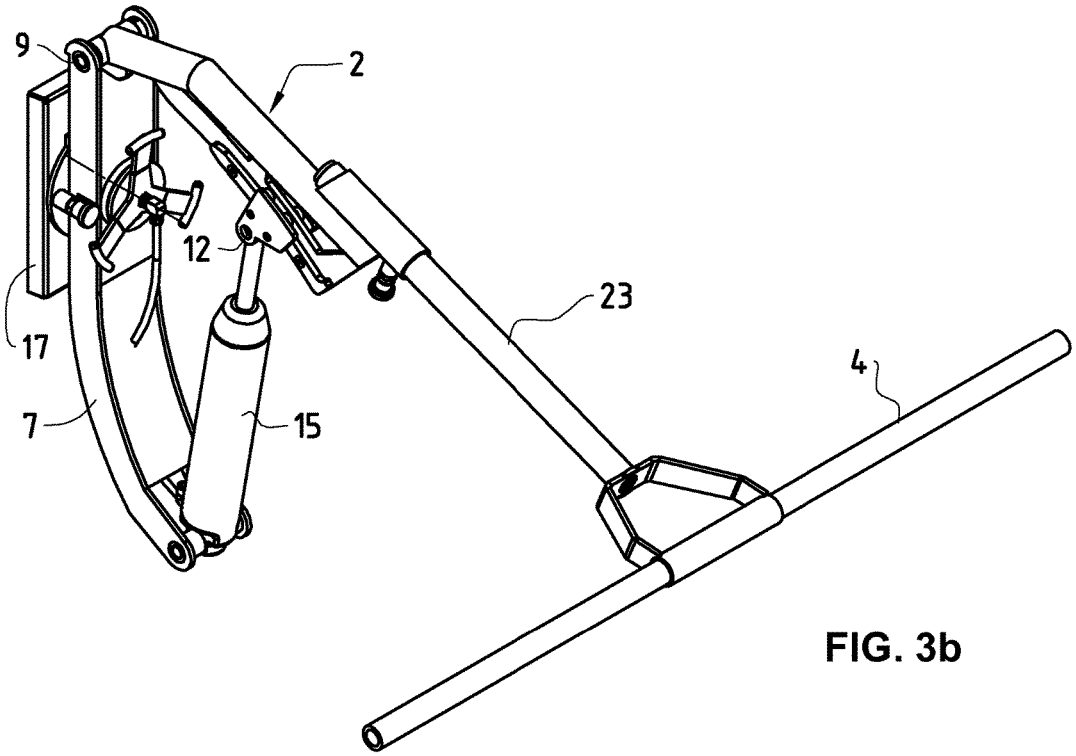

Shown in FIGS. 1*a* and 1*b* as well as 2*a* and 2*b* is the apparatus according to the invention 1 with the power arm 2 as it is located in the uppermost starting position with extended spring element 11. FIGS. 3*a* and 3*b* show the apparatus 1 with the power arm 2 located in a slightly downwardly pivoted position, against the force which is exerted by the pneumatic cylinder 15. The first articulation point 12 is thereby located in a middle position.

Figure 4A:
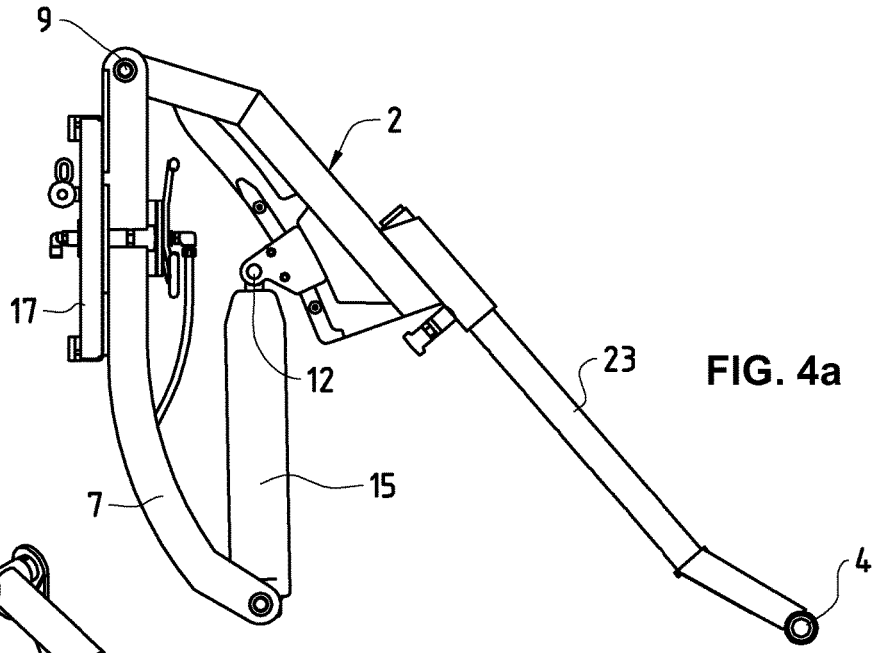
Figure 4B:
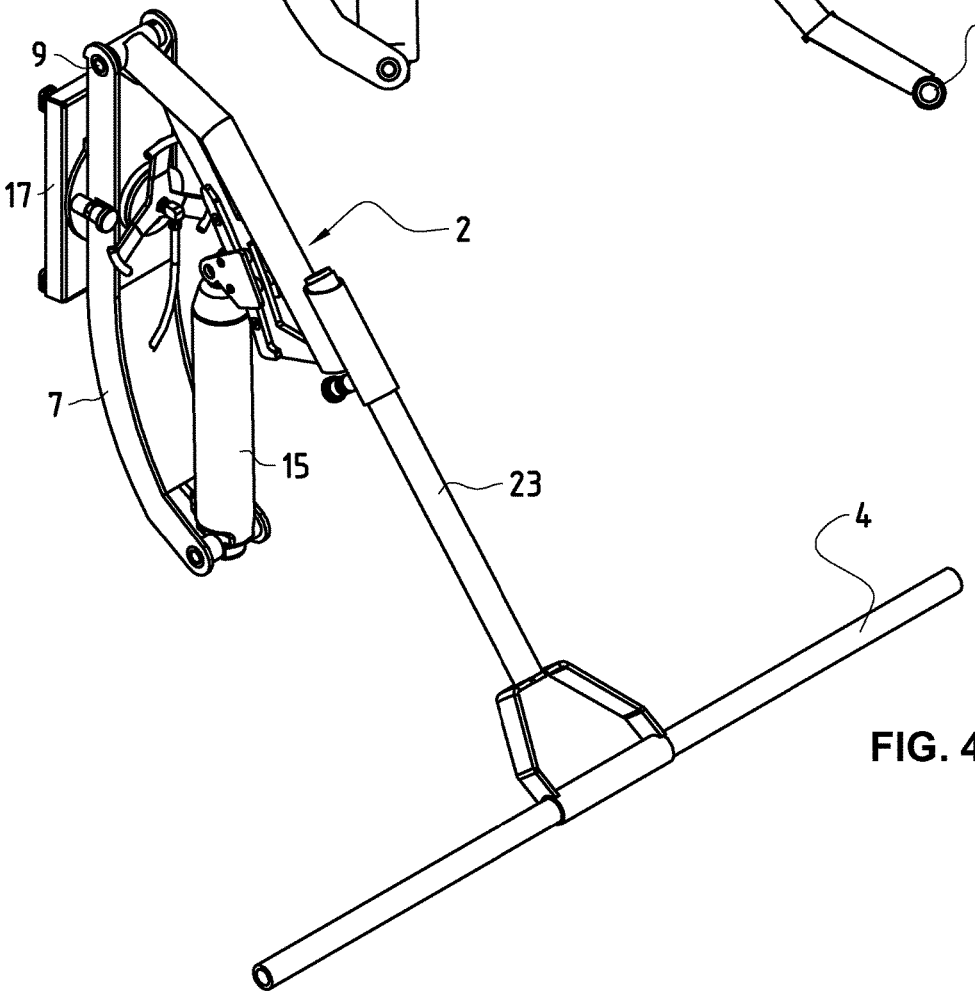

FIGS. 4*a* and 4*b* show the apparatus 1 with the power arm 2 in the lowermost position; the pneumatic cylinder 15 is located in the completely retracted situation. From this position the power arm 2 is pivoted again into the uppermost position, which is shown in FIGS. 1*a* and 1*b* or respectively 2*a* and 2*b*.

Figure 5:
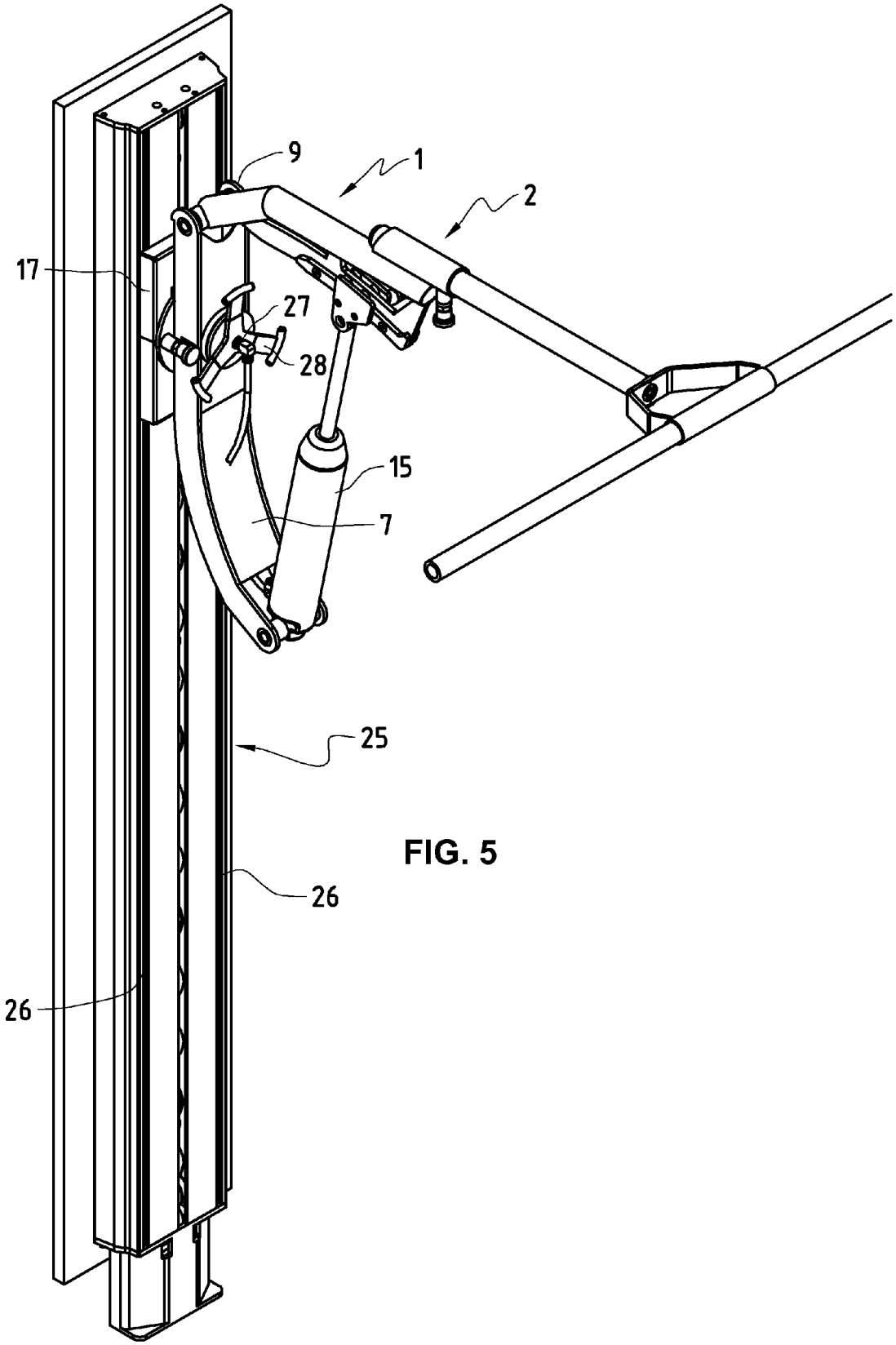
FIG. 5 shows in a spatial representation the apparatus according to the invention, which is disposed in a height-adjustable way on a stand.

FIG. 5 shows in a spatial representation the apparatus according to the invention 1 for exercising the muscles, which apparatus is disposed on a stand 25. In a known way this stand 25 has linear tracks 26, along which the support 17 is movable. For this purpose the support 17 is provided in a known way (not shown) with corresponding guide shoes. The support 17 can thereby be moved along the linear tracks 26 in the stand 25; the apparatus according to the invention is thereby able to be brought into any position with respect to the stand 25 and can be locked in this position. Provided for this purpose in a known way is a clamping bolt 27, which can tension tensioning pieces (not shown) with respect to the stand, which can be achieved through a clamping wheel 28 which is screwed on a corresponding threading that is provided on the clamping bolt. Of course other known and suitable moving and locking systems are also conceivable.

The stand 25 can be fixed in a known way to a wall of a room. It is also conceivable for the stand 25 to be mounted between ceiling and floor of a room. Via this stand the apparatus 1 for exercising the muscles can thus be brought to any desired height and locked at this height. The apparatus 1 can thus be brought to the optimal and desired height depending upon which group of muscles is supposed to be exercised.

Figure 6:
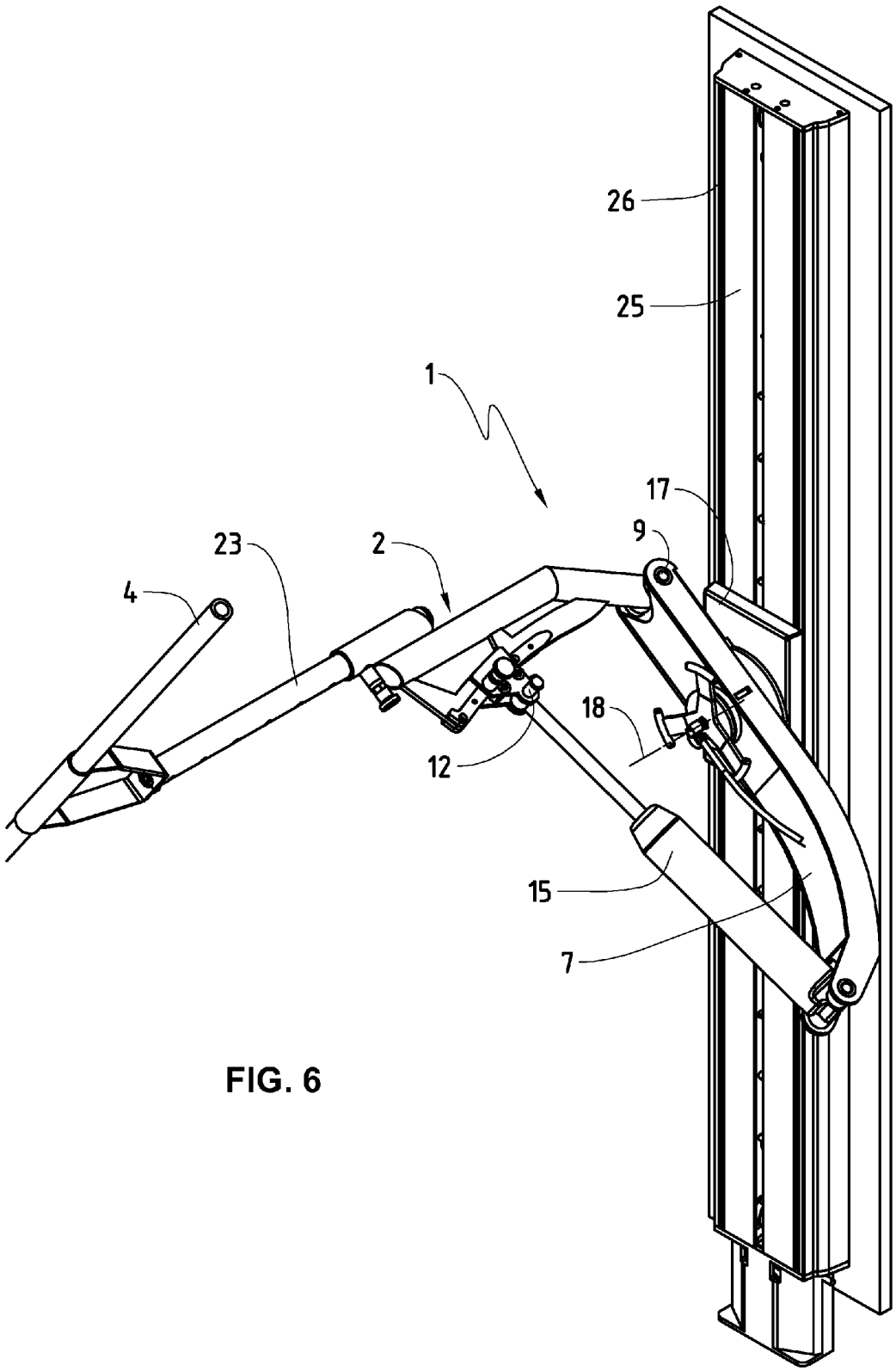
FIG. 6 and FIG. 7 show two different spatial representations of the apparatus according to the invention which is located in a position turned with respect to the support.
Figure 7:
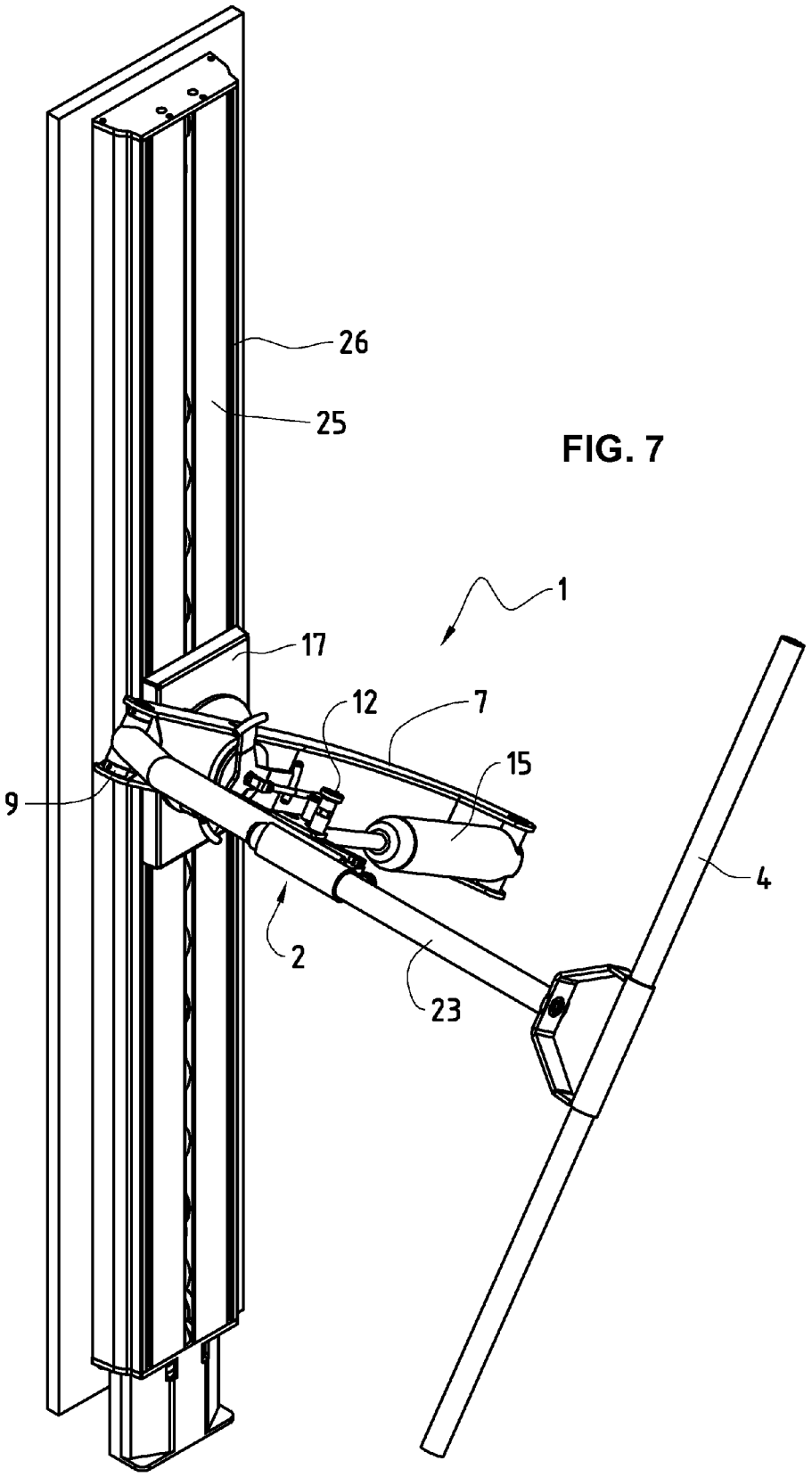

As can be seen from FIGS. 6 and 7, the arm 7 can be rotated about the shaft 18, with respect to the support 17, which is disposed on the stand 25. This rotation can take place from 0° to 360°. The direction of movement of the power arm can thus be set in any position.

Through the height adjustability of the apparatus 1 according to the invention and the rotation of the arm 7 with respect to the support 17 by 360° and the possibility of fixing in any set position, the power arm can be brought into practically any position. With a vertical movement of the power arm from above as well as from below to any desired height and the lateral movement of the power arm on both sides, whereby inclined movement upward to the left and right or respectively downward to the left and right are possible, the most diverse groups of muscles of a human body can be moved and exercised. Corresponding actuating elements can be used depending upon which groups of muscles are supposed to be moved and exercised. In the present example, a rod is used. This rod can easily be replaced by handles or grips, fixed to ropes, in which the hands or the feet can engage. Pressing pads or any type of hoops or stirrups can also be used. This apparatus according to the invention thereby offers an almost unlimited possibility of being able to move and exercise any group of muscles.

FIG. 8*a* and FIG. 8*b* show possibilities of how the apparatus according to the invention 1 can be stored in a space-saving way. The power arm 2 can be released from the spring element 11 or respectively from the pneumatic cylinder 15 by disengaging the first hinge 9, for example by pulling out the hinge pin. Ideally the apparatus is rotated with respect to the support 17 in such a way that the power arm is disposed hanging downward, while the pneumatic cylinder 15 is disposed upward. The power arm 2 can then be pivoted downward about the first hinge 9. The spring element 11 or respectively the pneumatic cylinder 15 then hang downward at the other end area 14 of the arm 7. The extension piece 23 can be removed from the power arm 2 and inserted in a corresponding accommodation in the stand 25. The actuating element 4 can likewise be accommodated in the stand 25. In this manner the apparatus can be stored in a space-saving way.

As can be seen from FIGS. 9*a* and 9*b*, the stand 23 can be housed in a cupboard element 29 which is provided with two doors 30 and 31. As has been described with reference to FIGS. 8*a* and 8*b*, the apparatus 1 can then be collapsed or folded in such a way that the two doors 30 and 31 of the cupboard element 29 can be closed. The apparatus for exercising the muscles is thus accommodated in this cupboard element for storage. The cupboard element can be aesthetically designed in such a way that it can be easily put in an office or bedroom or even in a living room without it being considered objectionable.

As can be seen from FIG. 10, the pneumatic cylinder 15 is connected to a compressed air reservoir 33 via a compressed air line 32. Connected to the compressed air line 32 is a manometer 34 which indicates the pressure prevailing within the system. Moreover, to prevent the pressure in this system from being able to become too high, a pressure limit valve 35 is inserted in the compressed air line 32. A pneumatic source 36 can be connected to the compressed air line 32, which source can be a compressor, for example, or also a hand-actuated pump or a similar suitable element. Provided in addition is a pressure relief valve 37, by means of which pressure can be released from the system. Via the pneumatic source 36 and the pressure relief valve 37 the pressure present in the system can thereby be changed, whereby the force taking effect through the pneumatic cylinder 15 can be adjusted. Inserted in addition in the compressed air line 32 can be a pipe anti-burst device 38, which brakes the power arm of the apparatus in the case of a defect within the system or in the case of faulty operation, such as the unintentional release of the power arm.

The apparatus according to the invention for exercising the muscles offers the widest range of possibilities as to how the force or respectively the force path during the stroke of the power arm can be changed. On the one hand the air pressure within the pneumatic system can be changed. On the other hand, the spacing of the first articulation point 12 with respect to the first hinge 9 (FIG. 1*a*) can be changed. In addition, the extension piece 23 (FIG. 2*a*) can be pushed into the power arm 2 and can be pulled out of this power arm, whereby here too the spacing between the actuating elements 4 and the first hinge 9 can be changed. Through all these adjustment possibilities the progression or path of the force which must be exerted on the power arm 2 during the stroke can be changed. Shown in the diagram according to FIG. 11 are such force paths. The vertical axis 38 indicates the change in force in %. The horizontal axis 39 indicates the stroke of the power arm 2. The curve 40 shows a progressive force path in which the force during the stroke of the power arm increases. The curve 41 shows a substantially constant force over the entire stroke. The curve 42 shows a declining force; the force to be expended decreases over the stroke of the power arm. Through these possibilities, adjusted in a completely targeted way can be how the path of force should look, depending upon the desired effect on the group of muscles to be exercised or moved.

Shown in FIGS. 12*a* and 12*b* are once again the individual components of the apparatus 1 according to the invention. Visible in particular in FIG. 12*b* is the configuration of the bores 43 in the support 17, via which the respective angular position of the arm 7 can be fixed via the locking pin 19, as has already been mentioned. Also visible in these two FIGS. 12*a* and 12*b* is likewise the compressed air line 32, which is connected to the pneumatic cylinder 15, and which is led in a known way over the shaft 18 through the arm 7 and the support 17 and comes out into the stand 25. Through this configuration the compressed air supply can be optimally brought into the pneumatic cylinder without the rotatability of the arm 7 with respect to the support 17 being impaired.

FIG. 13*a* schematically shows a counterbalance feature 50 in a known way in the support 25, which is in the form of a counterweight or a spring balancer. Using a counterweight the weight of the apparatus 1 can be compensated so that the height adjustment of the apparatus 1 with respect to the stand 25 can take place without any effort. Instead of the counterweight, however, a spring balancer can be provided in a known way (not shown). Conceivable is however also a rubber cable pull which could be guided via correspondingly disposed rollers 44.

Disposed in a known way (not shown) in the support 25 can be a counterweight with which the weight of the apparatus 1 can be compensated so that the height adjustment of the apparatus 1 with respect to the stand 25 can take place without any effort. Instead of the counterweight, however, a spring balancer can be provided in a known way (not shown). Conceivable is however also a rubber cable pull which could be guided via correspondingly disposed rollers 44.

Obtained with this solution according to the invention is an apparatus for exercising the muscles which is very simple in construction, but which can also be used in an extremely versatile way and can be stored in a space-saving manner. This apparatus is suitable for exercising and moving the most diverse groups of muscles for every sports application. This apparatus can however also be used for therapeutic purposes.

The invention claimed is:

1. An apparatus for exercising the muscles, comprising:

a power arm having an actuating element at one end area, and where the other end of the power arm is pivotally connected to a holding, elemental through a first hinge;

a spring element, wherein one end of the spring element is linked to the power arm at a first articulation point, and a second end of the spring element is linked to the holding element through a second articulation point;

a support lying on an imaginary plane defined by an x-axis and a y-axis, wherein the holding element is connected to the support by a rotary hinge that allows the holding element to rotate with respect to the support about a shaft lying along an axis normal to the imaginary plane; and a locking mechanism that allows the holding element to be fixed in a rotated position relative to the support.

2. The apparatus for exercising the muscles according to claim 1, wherein the spring element is a pneumatic cylinder.

3. The apparatus for exercising the muscles according to claim 2, wherein the pneumatic cylinder is connected to a compressed air reservoir via a compressed air line.

4. The apparatus for exercising the muscles according to claim 3, wherein a manometer and a pressure limit valve are associated with the compressed air line.

5. The apparatus for exercising the muscles according to claim 3, wherein a pneumatic source is connectable to the compressed air line, and a depressurization system is associated with the compressed air line such that a pressure of the compressed air is changeable.

6. The apparatus for exercising the muscles according to claim 1, wherein the support is installed in a height-adjustable way on a stand, the stand being fixable with respect to a wall of a room or in the room, the support being lockable at the adjusted height.

7. The apparatus for exercising the muscles according to claim 6, wherein the support is held at the respective height in the stand via a counterforce.

8. The apparatus for exercising the muscles according to claim 7, wherein the counterforce is provided by a counterweight or a spring balancer.

9. The apparatus for exercising the muscles according to claim 1, wherein the power arm is provided with an extension piece for accepting the actuating element, and which is telescopically extensible into and out of the power arm to be locked in an appropriate position.

10. The apparatus for exercising the muscles according to claim 1, wherein said actuating element is removably interchangeable with a different actuating element.

11. The apparatus for exercising the muscles according to claim 1, wherein the power arm and the spring element are separable from one another at the first articulation point and the power arm is configured to be swung closed toward the holding element.

12. The apparatus for exercising the muscles according to claim 11, wherein a stand is disposed in a cupboard element provided with doors and configured to be closable when the power arm is swung closed toward the holding element.

13. The apparatus for exercising the muscles according to claim 1, wherein the holding element is an arm, the first hinge being disposed at one end area of the arm and the spring element being linked in an articulated way at another end area of the arm.

14. The apparatus for exercising the muscles according to claim 1, wherein the first articulation point is positioned on a sliding piece that is slidably attached to a track disposed on the power arm so that the spacing between the first articulation point and the first hinge is adjustable.

* * * * *